United States Patent [19]

Ikeda

[11] 4,221,937

[45] Sep. 9, 1980

[54] MOVING IRON TYPE CARTRIDGE

[75] Inventor: Isamu Ikeda, Tokyo, Japan

[73] Assignee: Fidelity-Research, Inc., Tokyo, Japan

[21] Appl. No.: 932,544

[22] Filed: Aug. 10, 1978

[51] Int. Cl.[2] ..... H04R 11/12

[52] U.S. Cl. ..... 179/100.41 M; 179/100.41 K; 179/100.41 Z; 274/37

[58] Field of Search ..... 179/100.41 K, 100.41 M, 179/100.41 Z; 274/37

[56] References Cited

U.S. PATENT DOCUMENTS

| | | | |
|---|---|---|---|
| 2,456,388 | 12/1948 | Cornwell | 179/100.41 Z |
| 3,151,221 | 9/1964 | Pyke | 179/100.41 K |
| 3,441,688 | 4/1969 | Shaper | 179/100.41 K |
| 3,700,829 | 10/1972 | Anneberg et al. | 179/100.41 Z |
| 4,075,418 | 2/1978 | Nemoto et al. | 179/100.41 Z |

*Primary Examiner*—James W. Moffitt
*Assistant Examiner*—Donald McElheny, Jr.
*Attorney, Agent, or Firm*—Burns, Doane, Swecker & Mathis

[57] ABSTRACT

A moving iron type cartridge comprising a mounting base, a pair of permanent magnets for right and left channels secured to said mounting base, yokes for the right channel secured on the pole sides of said permanent magnet for the right channel and partially to the mounting base and having a coil wound thereon, yokes for the left channel secured on the pole sides of said permanent magnet for the left channel and partially to the mounting base and having a coil wound thereon, a damper case positioned at the end portions of said yokes and secured to the mounting base, a damper housed in said damper case, and a cantilever secured to said damper and having a stylus fixed to the tip thereof, whereby the stylus replacing operation can be easily performed and the outputs of a high level can be obtained.

1 Claim, 9 Drawing Figures

MOVING IRON TYPE CARTRIDGE

The present invention relates to MI-type cartridges, i.e., to cartridges of the so-called "moving iron" type.

A conventional cartridge of the kind referred to herein has been constructed, for example, as shown in FIG. 1. In FIG. 1, 1 is a yoke for a right channel, 2 is a yoke for a left channel. A cantilever 4 with a stylus at its end which is integrated with a magnetic member 5 and held by a mounting base (not shown) through a damper 6 is placed in a space 3 surrounded by the end portions of said two yokes 1 and 2 which extend longitudinally approaching to each other. In the vicinity of said magnetic member 5, a permanent magnet 7 is arranged to magnetize the magnetic member. In this construction, however, as the cantilever 4 is located in a narrow space 3 defined with the end portions of the yokes 1 and 2, the replacement of a worn-out stylus is forced to be extremely troublesome. Furthermore, a mechanical pressure is likely to be applied to the yokes 1 and 2 which are usually made of mu metal, when the stylus is replaced with a new one, so that the magnetic characteristics of the yokes are caused to change and accordingly performance of the cartridge may become gradually inferior.

When employed in a power generation mechanism, the magnetic member 5 of the cantilever 4 is to oscillate within a narrow space 3, not providing a sufficient moving range in the design and, consequently, it is difficult for the mechanism to obtain outputs of a high level.

The present invention has been suggested so as to eliminate the abovementioned defects.

The principal object of the present invention is to provide an MI-type cartridge in which the stylus replacing operation can be easily performed.

Another object of the present invention is to provide an MI-type cartridge which is able to give outputs of a high level, A further object of the present invention is to provide an MI-type cartridge in which the follow-up characteristics of the stylus is excellent.

Other objects and effects of the present invention shall be made clear upon reading the following detailed description of the present invention along preferred embodiments with reference to the accompanying drawings, in which.

Figure 1:
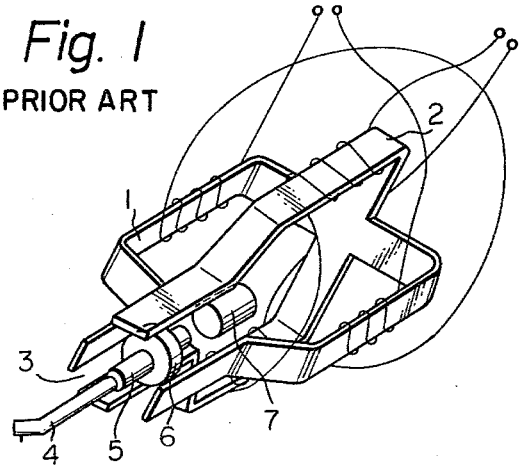
Fig. 1 PRIOR ART
FIG. 1 is a perspective view of a conventional cartridge.
Figure 2A:
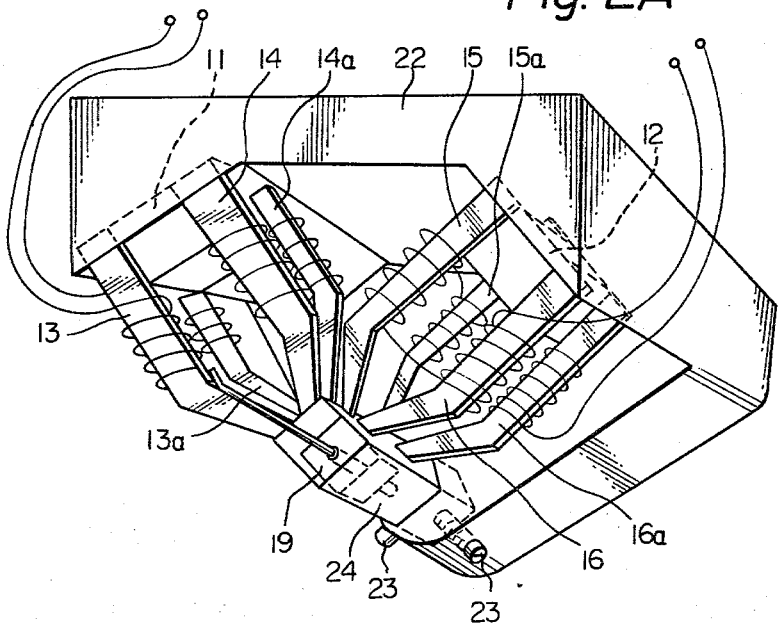
FIG. 2A is a perspective view of an MI-type cartridge according to the present invention.
Figure 2B:
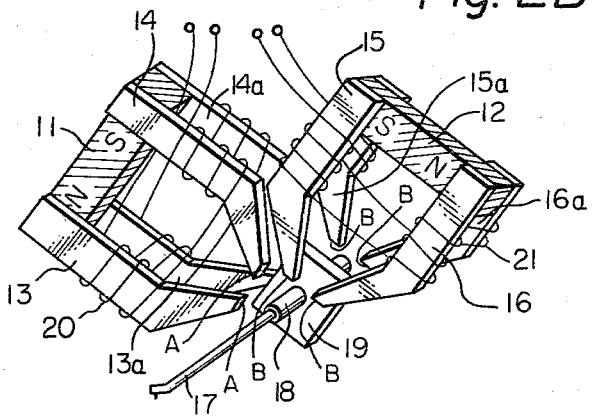
FIG. 2B is a perspective view showing only the internal mechanism of an MI-type cartridge.

In FIGS. 2A and 2B, 11 and 12 are permanent magnets for the right and left channels respectively. The magnets are magnetized into N pole at one end and S pole at the other end respectively and further provided respectively with two pairs of yokes 13, 13*a* and 14, 14*a* at the ends of the permanent magnet 11, whereas two pairs of yokes 15, 15*a* and 16, 16*a* are provided at the ends of the permanent magnet 12.

The permanent magnets 11, 12 and the base portions of the yokes 13, 13*a*, 14, 14*a*, 15, 15*a*, 16 and 16*a* are connected to and integral with a mounting base 22 of a synthetic resin. The magnets 11, 12 are mounted on two mounting planes 22A, 22B of the base 22. The respective pair of the yokes 13 and 14, 13*a* and 14*a*, 15 and 16, and 15*a* and 16*a* which are connected to the permanent magnets 11 and 12 extend to approach each other at the end surfaces. The end surfaces 13', 13*a*' and 14', 14*a*' of the two pairs of yokes 13, 13*a* and 14, 14*a* which are attached to one permanent magnet and the end portions 15', 15*a*' and 16', 16*a*' of the other two pairs of yokes 15, 15*a* and 16, 16*a* attached to the other permanent magnet are arranged so as to terminate on the respective same planes defined respectively by end surfaces A of yokes 13, 13*a*, 14, 14*a*, and end surfaces B of yokes 15, 15*a*, 16, 16*a*.

The two planes on which the respective end portions of the yokes of said right and left channels are arranged, make an angle of 45° respectively with respect to the surface of a phonograph record (not shown), and further make an angle of 90° with respect to each other.

A cantilever 17 which is integral with a magnetic member 18 and held on the mounting base 22 through a damper 19 is arranged to oscillate freely within a region defined by the two planes making an angle of 90° with respect to each other as described above.

The damper 19 is inserted into and fixed to a damper case 24 which is attached to the mounting base 22 with screws 23.

The cantilever 17 and the magnetic member 18 aligned therewith are arranged to be substantially parallel in the axial direction to said planes in the stationary state, whereas to oscillate in response to the action of the stylus when a phonograph record is played. The yokes 13–16*a* can be made of a so-called laminated material according to demand. Coils 20 and 21 are wound appropriately on the yokes 13–14*a* for the right channel and on the yokes 15–16*a* for the left channel respectively for inducing a current in response to a change of the magnetic flux passing through the yokes. In the embodiment illustrated, the coil 20 is wound clockwise on the yoke 13 fixed to the N pole side of the permanent magnet 11, then wound counterclockwise on the opposite yoke 14 on the S pole side, further counterclockwise on the yoke 14*a* opposing to the yoke 14 on the S pole side and then again clockwise on the yoke 13*a* on the N pole side opposite to said yoke 14*a*. The coil 21 is wound on the yokes 15–16*a* in the same manner as described above. In short, the coils 20, 21 are wound not to cancel but, to superpose currents induced electro-magnetically in response to the change of the magnetic flux passing through the yokes 13–16*a*. It is easily understood that the holding mechanism of the cantilever 17 is constructed substantially in the same way as in the conventional cartridges.

Figure 3A:
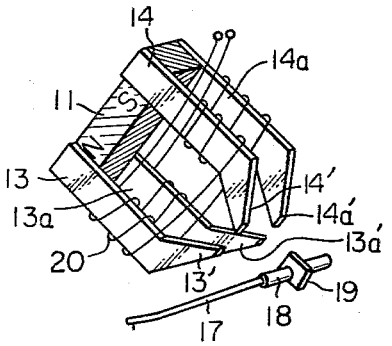
FIGS. 3A, 3B, 4A, 4B, 5A and 5B are explanatory drawings of the operation of the cartridge according to the present invention.
Figure 3B:
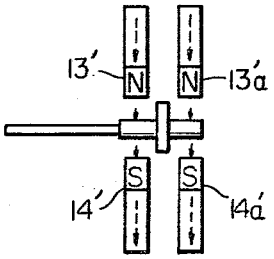

Hereinafter, the operation of the cartridge according to the present invention will be described in detail. The right and left channels are constituted substantially in the same way, therefore the description will be given only to the right channel. FIGS. 3A and 3B show the cartridge in a stationary state wherein the magnetic flux from the N pole of the permanent magnet 11 passes through the yoke 13, the end portion 13' of the yoke 13, the magnetic member 18 of the cantilever 17, the end portion 14' of the yoke 14, and the yoke 14 reaching the S pole of the permanent magnet 11. Also, the magnetic flux from the N pole of the permanent magnet 11 passes through the yoke 13*a*, the end portion 13*a*' of the yoke 13*a*, the magnetic member 18 of the cantilever 17, the end portion 14*a*' of the yoke 14*a*, and the yoke 14*a* reaching the S pole of the permanent magnet 11. In this state, there will be caused no change in the flux flow, and through the coil 20 there flows a constant magnetic flux in the reverse direction inducing no electromotive force.

Figure 4A:
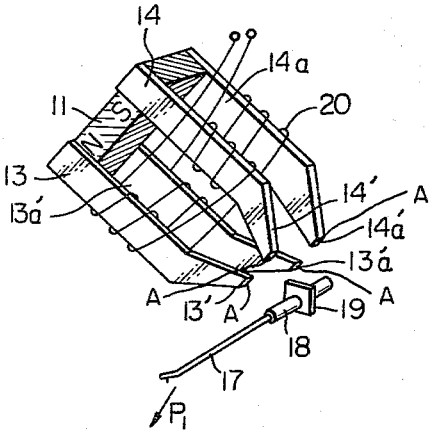
Figure 4B:
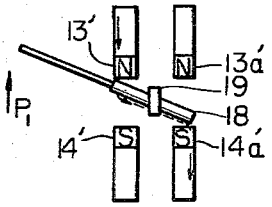

On the other hand, FIGS. 4A and 4B show a case wherein the cantilever is moved in a certain direction P1. In this case, a magnetic circuit is formed through the end portions of yokes 13' and 14a' located symmetrically with respect to the damper 19, that is, the flux passes through tye yoke 13, the end portion 13' of said yoke 13, the magnetic member 18, and the end portion 14a' of the yoke 14a, inducing an electromotive force in the clockwise direction with respect to the flux flow. At the same time, in the yoke 13a from which the magnetic member 18 is separated the flux is suddenly reduced, inducing a counter electromotive force and thus providing outputs of a sufficiently high level between both ends of the coil 20.

Figure 5A:
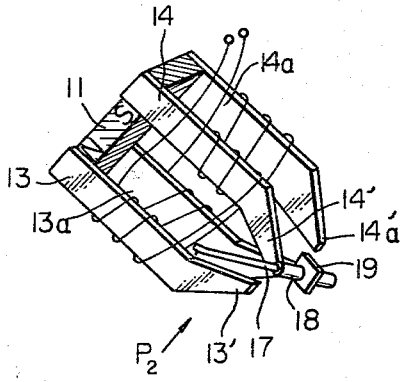
Figure 5B:
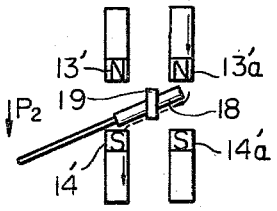

In the case shown in FIGS. 5A and 5B, if the cantilever 17 is moved in the reverse direction P2 to the direction in the case of FIGS. 4A and 4B, the flux flows through the yoke 13a, the end portion 13a' of the yoke 13a, the magnetic member 18, and the end portion 14' of the yoke 14 inducing in electromagnetic force in the clockwise direction with respect to the flux flow. At the same time, in the yoke 13 from which the magnetic member 18 is separated, the flux is suddenly reduced, inducing a counter electromagnetic force and thus providing outputs of a sufficiently high level between both ends of the coil 20. If the polarity is reversed to the case as shown in FIG. 2 and correspondingly the winding direction is altered, the same effect may be obtained.

According to the MI-type cartridge constructed as mentioned above of the present invention, the following effects can be obtained;

(I) The cantilever is located in a region defined by two planes on which the end portions of the two channels are arranged and opened on the other lower two sides, therefore, the stylus replacement is far easier than in the conventional cartridge wherein the cantilever is located in a narrow space defined by the end portions of the yokes.

(II) The yokes are arranged only on two planes with respect to the cantilever, therefore, there exists no possibility of applying a mechanical pressure to the yokes when the cantilever is mounted and dismounted.

(III) The oscillation space for the cantilever can be secured sufficiently large and, accordingly, a power of higher level can be obtained.

(IV) The cantilever 17 is integrated with only the magnetic member 18. Further the magnetic member 18 can be made of a light metal of a high magnetic permeability such as sold under the name "Permalloy" to reduce the gross weight of the cantilever and the mass to a large extent. Accordingly, not only the stylus can be protected from wearing-off but also the follow-up characteristics of the stylus can be improved extraordinarily.

(V) The durability of and the reliability on the cartridge will be increased due to that outputs of a high level can be obtained with a high efficiency.

(VI) The magnetic member of the cantilever is to be excited powerfully and, thereby, a large output voltage can be obtained.

What is claimed is:

1. A moving-iron type stereophonic pick-up cartridge comprising:

a mounting base formed of a non-magnetic material and including first and second planes oriented at an angle relative to one another;

first and second permanent magnets mounted to respective ones of said mounting planes so that proximately located ends of said magnets are both of one polarity and distantly located ends of said magnets are both of the opposite polarity;

two pairs of right-channel yokes associated with said first magnet, each right-channel yoke including an inner end connected to said first magnet, and an outer end surface, said outer end surfaces lying in a first end plane parallel to said first mounting plane, the yokes of each respective pair of right-channel yokes having their inner ends connected to opposite polarities of said first magnet and their outer end surfaces spaced to form a gap therebetween, each pair of right-channel yokes forming a magnetic flow path across their associated gaps;

a right-channel coil wound in series around each of said right-channel yokes;

two pairs of left-channel yokes associated with said second magnet, each left-channel yoke including an inner end connected to said second magnet, and an outer end surface, said outer end surfaces of said left-channel yokes lying in a second end plane parallel to said second mounting plane;

the yokes of each respective pair of left-channel yokes having their inner ends connected to opposite polarities of said second magnet and their outer end surfaces spaced to form a gap therebetween, each pair of left-channel yokes being magnetically connected across their associated gaps;

a left-channel coil wound in series around each of said left-channel yokes;

a damper case mounted to said base and extending equidistantly from all of said end surfaces through the magnetic flow paths of all of said gaps;

a damper disposed in said damper casing between said two pairs of right-channel yokes and between said two pairs of left-channel yokes;

a magnetic member held by said damper and extending through the magnetic flow paths of all of said gaps in spaced relation to said end planes within a region defined by said end planes; and a cantilever mounted at one end to said magnetic member in alignment therewith and carrying a stylus at its other end.

* * * * *